US007587963B1

(12) United States Patent
Broadus

(10) Patent No.: US 7,587,963 B1
(45) Date of Patent: Sep. 15, 2009

(54) COMBINATION PLIERS AND SPUDDING TOOL

(76) Inventor: Brad Broadus, P.O. Box 40, Calico Rock, AR (US) 72519

( * ) Notice: Subject to any disclaimer, the term of this patent is extended or adjusted under 35 U.S.C. 154(b) by 9 days.

(21) Appl. No.: 12/081,847

(22) Filed: Apr. 22, 2008

Related U.S. Application Data

(63) Continuation-in-part of application No. 11/808,716, filed on Jun. 12, 2007, now Pat. No. 7,530,296.

(51) Int. Cl.
*B25B 7/04* (2006.01)

(52) U.S. Cl. ..... 81/414; 81/489

(58) Field of Classification Search ..... 81/414, 81/489

See application file for complete search history.

(56) References Cited

U.S. PATENT DOCUMENTS

| | | | | |
|---|---|---|---|---|
| 753,048 | A | | 2/1904 | Des Moineaux |
| 854,248 | A | | 5/1907 | Smith |
| 1,615,450 | A | | 9/1919 | Zim |
| 1,341,712 | A | | 6/1920 | Gell |
| 1,342,856 | A | | 6/1920 | McDowell |
| 1,490,903 | A | | 4/1924 | Anderson |
| 1,498,844 | A | | 6/1924 | Laflin |
| 1,828,142 | A | * | 10/1931 | Herdman ..... 7/138 |
| 2,366,312 | A | | 1/1945 | Brintnall |
| 2,600,445 | A | | 6/1952 | Sundstand |
| 3,333,492 | A | | 8/1967 | Chapman |
| 4,375,174 | A | | 3/1983 | Shanley, Jr. |
| 4,539,873 | A | | 9/1985 | Freed |
| 4,794,824 | A | | 1/1989 | Chapman |
| 5,575,029 | A | | 11/1996 | Simpson |
| 5,809,853 | A | | 9/1998 | Hudson |
| 6,081,952 | A | | 7/2000 | Haxton |
| 6,901,823 | B2 | * | 6/2005 | Ernesti ..... 81/60 |

* cited by examiner

*Primary Examiner*—Joseph J Hail, III
*Assistant Examiner*—Shantese McDonald
(74) *Attorney, Agent, or Firm*—Dowell & Dowell, P.C.

(57) ABSTRACT

A combination tool that includes opposing jaws and handles that function as conventional pliers and wherein the handles are configured to be abutted with one another to form a spudding tool having a generally circular cross section and wherein one of the handles cooperatives seats within and fills a slot in the opposing handle when the handles are abutted with one another.

7 Claims, 3 Drawing Sheets

Replacement Sheet
12/081,847

COMBINATION PLIERS AND SPUDDING TOOL

CROSS REFERENCE TO RELATED APPLICATIONS

This application is a Continuation-in-Part of U.S. patent application Ser. No. 11/808,716, filed Jun. 12, 2007, in the name of the same inventor and the entire contents of which are incorporated herein by reference.

BACKGROUND OF THE INVENTION

1. Field of the Invention

This application is directed to a combination hand tool that may be used as conventional pliers, and preferably, channel lock pliers, as well as for a spudding tool that may be used to engage and align parts, components and other structural elements by hand wherein one or more openings in the structural elements to be aligned are used to manipulated the structural elements with respect to one another.

2. Brief Description of the Related Art

Spudding tools are hand held or manipulated tools that include a pointed shaft that is tapered from a pointed end outwardly to a handle. Such tools are used to facilitate the alignment of parts, plates or other members that are to be aligned for one reason or another, such that they be ultimately connected or joined. Such tools are commonly used by iron workers, millwrights, metal building fabricators and erectors, machinists, shop mechanics, concrete form assemblers and the like.

Conventional spudding tools are formed as a single "shaft-like" device that is integrally formed of a metal material. The tools have very limited functionality and are specifically designed and configured for use as alignment probes for specific members, objects or structures or to clear holes that must be cleaned or finished in order to permit bolts or other fasteners to be inserted and properly seated therein during a "bolt-up" assembly of parts or components.

Unfortunately, because of their limited functionality for the alignment of two or more separate objects or the finishing or clearing of holes, such tools have been exclusively required as separate members of a workers tool set. Further, because the size of the members, objects or structures to be aligned or finished may vary, workers must often carry a plurality of spudding tools.

Often, those who must use spudding tools must also have tools that are useful to grip and manipulate objects in a manner that is possible using pliers or the like. Therefore, such workers must carry a plurality of separate tools to perform separate hand manipulative functions. Not only does the need for a plurality of separate tools require a greater economic expenditure to be made for the tools used in a specific trade, but the need to carry additional tools for separate unique functions adds to the logistical burdens that are placed on workers to carry the tools on work projects.

In view of the foregoing, there is a need to provide a tool that is unique and multi-functional and not only provides usefulness as a hand held pair of pliers, or the like, but wherein the pliers may also be used in a safe manner as a spudding tool to facilitate the alignment of parts and components as may be necessary on a specific work site or to clear or finished rough openings or holes in work members.

SUMMARY OF THE INVENTION

This application is directed to a combination hand tool that includes a pair of opposing jaws that may be manipulated in the manner of conventional pliers, or the like, and more particularly, to a tool having a pair of hand manipulated handles that are used to control movement and force generated by the opposing jaws of the tool and, wherein, the tool may be used as a spudding tool by interengaging the handles of the tool with one another, when the handles are closed relative to one another, to thereby create a reinforced and pointed rod-like spudding tool.

More specifically, with the present invention, a first handle is generally conically shaped along a substantial portion of a length thereof so as to taper inwardly toward an outer tip end of the handle. An inner slot or channel extends along at least a portion of the length of a portion of the first handle that faces an opposing second handle. The second handle is of a configuration to cooperatively and closely seat within the slot and an outer surface thereof is curved to be compatible to the conical outer surface of the first handle. In this manner, when the two handles are closed relative to one another, they form a conically shaped spudding tool that tappers inwardly to a pointed end and which tool is generally circular in cross section at any plane taken perpendicularly to an elongated central axis of the first handle. In the preferred embodiment shown, the slot extends along only a portion of the length of the first handle, however, in another embodiment the slot may extend substantially along the entire length of the first handle.

It is a primary object of the invention to provide a combination tool that may be used as a conventional pair of pliers, such as a pair of channel-lock pliers and wherein, when the handles of the pliers are closed relative to one another, the handles interlock with one another such that the opposing handles form a conical rod shaped structure that tapers inwardly toward an outer tip end thereof such that the handles may be used as a spudding tool.

It is another object of the invention to both reduce tool costs and to enhance the usefulness of a single tool to provide for a plurality of differing work functions.

BRIEF DESCRIPTION OF THE DRAWINGS

A better understanding of the present invention will be had with reference to the accompanying drawings wherein.

DESCRIPTION OF THE PREFERRED EMBODIMENT

Figure 1:
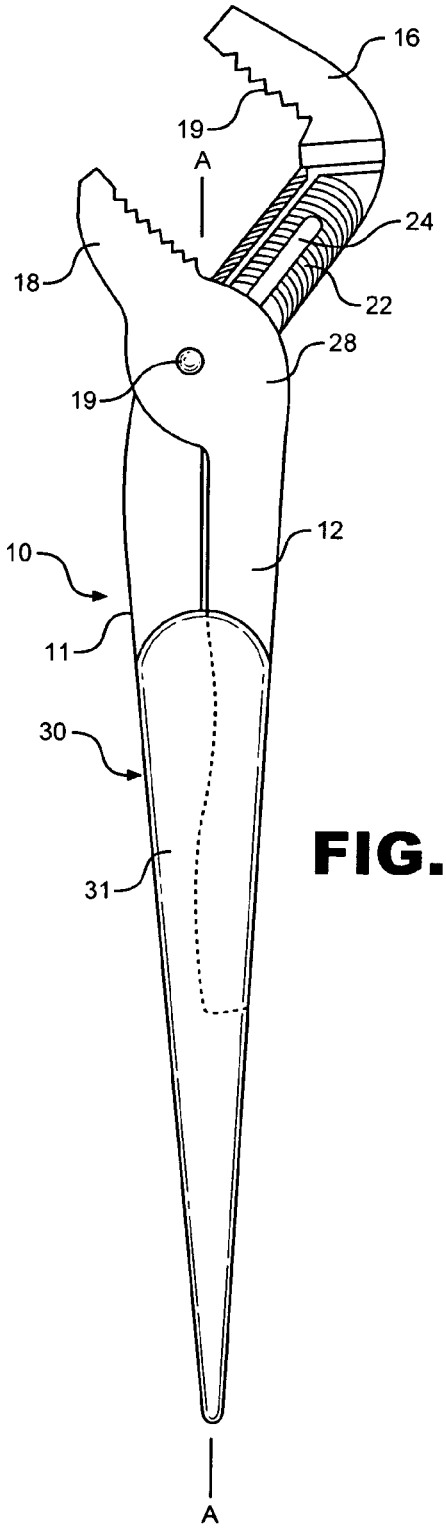
FIG. 1 is a side view of a pair of channel lock pliers that includes opposing handles that are configured to be cooperatively seated relative to one another to form a conically tapered and pointed spudding tool when they are closed together as shown.
Figure 2:
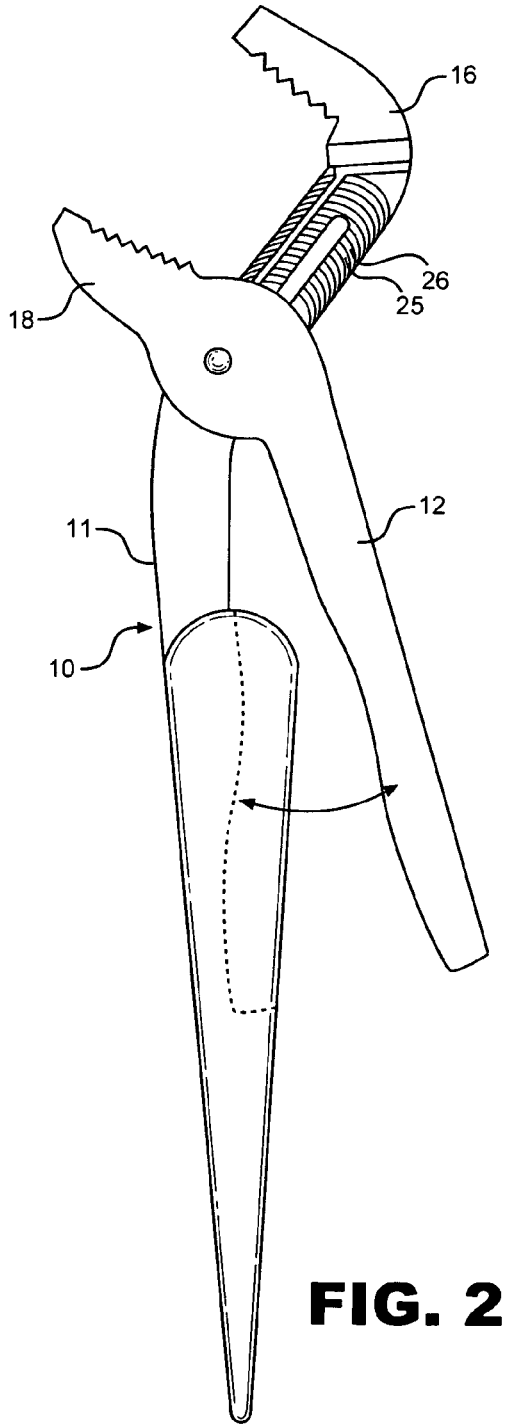
FIG. 2 is a side view of the pliers of FIG. 1 showing the handles spaced from one another.

With continued reference to the drawings, the combination hand tool of the invention includes a pair of pliers 10, which are shown as channel lock pliers having a pair of handles 11 and 12 that are connected to one another by a pivot pin 14. The handles are integrally formed with opposing jaw members 16 and 18 that are preferably provided with teeth 19 to facilitate gripping an object to be manipulated by the pliers. As the preferred embodiment shown in the drawings is directed to a pair of channel lock type pliers, the jaws and handles are connected by the pivot pin so as to be selectively adjustable relative to one another such that the spacing between the jaws may be varied as required. In this respect, jaw member 16 is connected to handle 11 by way of an integral connector segment 22 that includes an elongated slot 24 in which the pivot pin 14 is guidingly retained such that an actual pivot point between the jaws may be varied as desired.

In order to constrain the arcuate movement of the jaws in a fixed arcuate motion relative to one another regardless of the position of the pivot pin with respect to the slot 24, a series of generally equally spaced and arcuate ridges 25 and grooves 26 are formed in the connector segment that mesh with complementary arcuate ridges and grooves, not shown, that are formed in a connector segment 28 of the opposite handle 12. The meshed engagement of the opposing ridges and grooves ensures an arcuate motion of the opposing jaws relative to one another regardless of the spacing there between. Thus the jaws may be adjusted in increments between a maximum spacing, as shown in FIG. 1 to closed relationship not shown in the drawing figures.

As previously described, conventional spudding tools are rod-like tools that are somewhat conically shaped or taper inwardly from a handle portion to a narrow tip that is used to adjust the position of one part or element with respect to another or to clear holes that must be cleaned or finished in order to permit bolts or other fasteners to be inserted therein during a "bolt-up" assembly of parts or components. Because of the area of use, spudding tools are generally circular in cross section with the diameter of the tools progressively narrowing along a length of the handles to the tips of the tools.

As shown in the drawing figures of the present invention, handle 11 is formed having a portion thereof 30 that is generally of a conical configuration having an outer surface 31. The handle 11 has an elongated central axis "A". The configuration of the handle 11 is generally such that any cross section there through taken perpendicularly relative to the elongated axis "A" will be generally circular, see FIG. 5, such that handle 11 may be used as a spudding tool.

Figure 3:
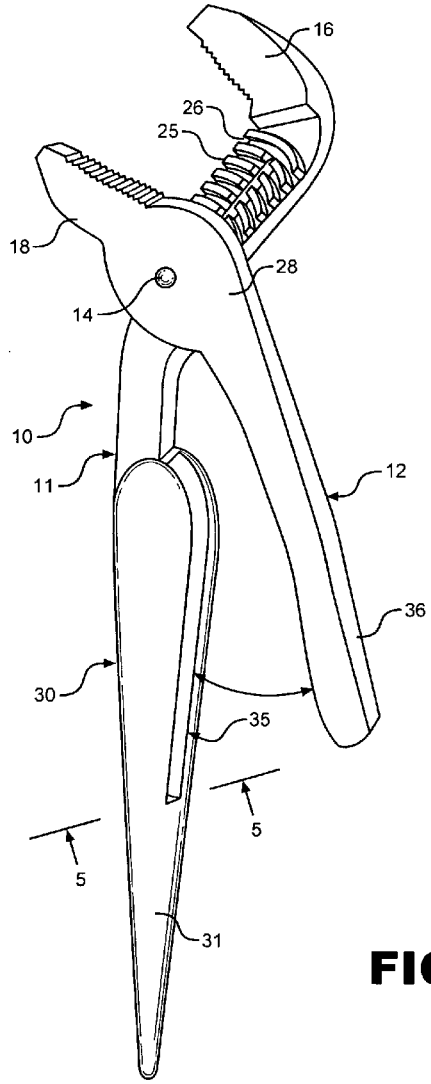
FIG. 3 is a rear perspective view of the combination tool of FIG. 2 showing a slot in one of the handles that cooperatively receives a complementary shaped opposing tool handle.
Figure 4:
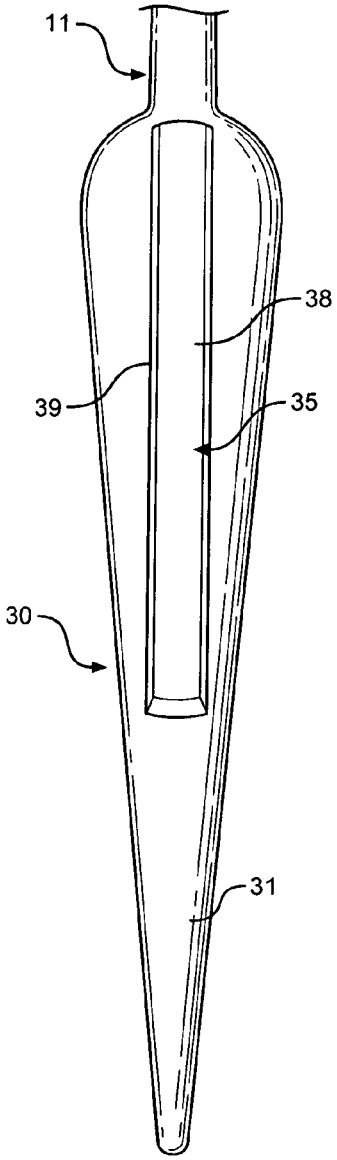
FIG. 4 is a partial rear elevational view showing the slot in one handle of the combination tool of the invention.
Figure 5:
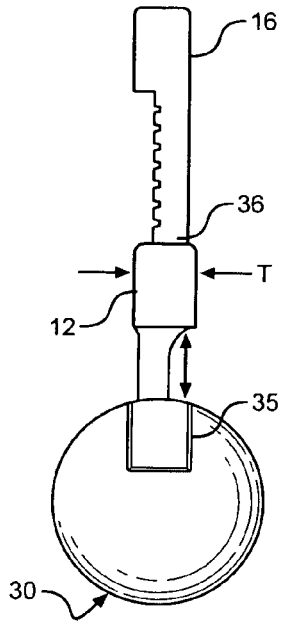
FIG. 5 is a cross sectional view taken along line 5-5 of FIG. 3.

In order to reinforce the handle 11 when used as a spudding tool, a slot or channel 35, see FIGS. 3-5, is provided along at least a portion of the length of the handle in which the handle 12 may be cooperatively received. Although the length of the slot 35 is shown in the drawings as being less that a length of the handle portion 30 of handle 11, in some embodiments, the slot may extend substantially along the full length of the handle portion 30. As shown, the size and configuration of the handle 12 is such that it fits closely within and fills the slot 35 when the handles are closed relative to one another. Further, an outer surface 36 of the handle 12 is rounded so that it completes the conical appearance of the portion 30 of the handle 11 when the handles are closed relative to one another as shown in FIG. 1.

As shown in FIGS. 3-5, the slot or channel 35 is defined by generally parallel side walls 38 and 39 which are spaced apart a distance just slightly greater than a thickness dimension "T" of the handle 12, see FIG. 5. In this manner, when the handles are closed relative to one another to form a spudding tool, the handles reinforce one another and their interengaged arrangement will prevent accidental slippage of one handle relative to the other.

As shown in FIG. 1, in the preferred embodiment, only when the jaws of the combination tool are opened to their widest extent such that the pivot pin 14 rests against an end wall of the slot 24, are the handles properly aligned with one another to form the spudding tool. It is possible that the tool could be constructed such that the handles will only seat with one another when the jaws are closed relative to one another.

In view of the foregoing, the combination tool of the present invention provides usefulness as a conventional pair of pliers, and particularly, channel-lock pliers, and also provides usefulness as a spudding tool when the handles are brought together with the second handle seated within the first.

The foregoing description of the present invention has been presented to illustrate the principles of the invention and not to limit the invention to the particular embodiments illustrated. It is intended that the scope of the invention be defined by all of the embodiments encompassed within the following claims and their equivalents.

I claim:

1. A combination tool comprising a pair of pliers having a pair of opposing jaws that extend from opposing first and second handles, pivot means pivotally connecting the opposing first and second handles to one another, each of said first and second handles having opposing inner surfaces and oppositely oriented outer surfaces, a portion of a length of said first handle being generally conical and tapering inwardly toward a tip thereof so as to define a spudding tool, a slot formed in said inner surface of said first handle, said second handle being of a size to be cooperatively seated within and fill said slot when said second handle is closed relative to said first handle wherein said second handle reinforces said spudding tool.

2. The combination tool of claim 1 wherein said outer surface of said second handle is generally convex so as to define a portion of an outer surface of said generally conical portion of said first handle when said first and second handles are closed into engagement with one another.

3. The combination tool of claim 2 wherein a combined cross section of said first and second handles is generally circular taken in a plane generally perpendicular to a longitudinal central axis "A" of said first handle when said first and second handles are closed relative to one another.

4. The combination tool of claim 3 wherein said pivot means is adjustable along an open channel formed in a section intermediate one of the handles and associated jaws of the tool such that the spacing between opposing jaws may be varied from a close proximity relative to one another to a fully spaced relationship relative to one another.

5. The combination tool of claim 4 wherein said second handle only aligns to seat within said slot when the pivot means is positioned relative to the open channel to fully space the jaws relative to one another.

6. The combination tool of claim 3 wherein said slot extends only along a portion of a length of said generally conical portion of said first handle.

7. The combination tool of claim 6 wherein said slot is defined by generally parallel side walls.

* * * * *